US007963093B2

(12) United States Patent
Vanderbeken et al.

(10) Patent No.: US 7,963,093 B2
(45) Date of Patent: Jun. 21, 2011

(54) STEEL CORD WITH IRON-ZINC ALLOY COATING

(75) Inventors: Bert Vanderbeken, Waregem (BE); Paul Bruyneel, Ooigem (BE); Wouter Vandenbranden, Destelbergen (BE); Stijn Vancompernolle, Ghent (BE)

(73) Assignee: NV Bekaert SA, Zwevegem (BE)

( * ) Notice: Subject to any disclaimer, the term of this patent is extended or adjusted under 35 U.S.C. 154(b) by 88 days.

(21) Appl. No.: 12/526,858

(22) PCT Filed: Feb. 12, 2008

(86) PCT No.: PCT/EP2008/051638

§ 371 (c)(1), (2), (4) Date: Aug. 12, 2009

(87) PCT Pub. No.: WO2008/101831

PCT Pub. Date: Aug. 28, 2008

(65) Prior Publication Data

US 2010/0031623 A1 Feb. 11, 2010

(30) Foreign Application Priority Data

Feb. 19, 2007 (EP) ..... 07102605

(51) Int. Cl.
*D02G 3/02* (2006.01)

(52) U.S. Cl. ..... 57/223; 57/232; 57/241

(58) Field of Classification Search ..... 57/217, 57/221, 223, 232, 241
See application file for complete search history.

(56) References Cited

U.S. PATENT DOCUMENTS

| | | | | |
|---|---|---|---|---|
| 4,651,513 | A | 3/1987 | Dambre | |
| 5,059,455 | A * | 10/1991 | Hasselbach et al. | 427/292 |
| 5,768,874 | A | 6/1998 | Bourgois et al. | |
| 5,784,874 | A * | 7/1998 | Bruyneel et al. | 57/237 |
| 6,920,745 | B2 * | 7/2005 | Bruyneel et al. | 57/237 |
| 7,191,585 | B2 * | 3/2007 | Vanderbeken et al. | 57/223 |

FOREIGN PATENT DOCUMENTS

EP 1 280 958 B1 2/2003

* cited by examiner

*Primary Examiner* — Shaun R Hurley
(74) *Attorney, Agent, or Firm* — Foley & Lardner LLP

(57) ABSTRACT

A steel cord comprises more than one steel filament (10). At least some of the steel filaments have a zinc iron alloy layer (14) partially covered with a zinc cover (16). The zinc cover is only present in valleys formed in the zinc-iron alloy layer. The processability and adhesion level in rubber products of the steel cord are increased.

13 Claims, 4 Drawing Sheets

STEEL CORD WITH IRON-ZINC ALLOY COATING

FIELD OF THE INVENTION

The present invention relates to a steel cord. The steel cord is a multi-strand steel cord, i.e. a steel cord comprising more than one strand, and each strand comprises more than one steel filament or a single strand or layered steel cord. The invention also relates to various uses of the steel cord.

BACKGROUND OF THE INVENTION

U.S. Pat. No. 4,651,513 describes a steel cord for reinforcing rubber products comprising two or more successive wire layers of which an inward layer comprises wires coated a corrosion resistant coating and the outer surface layer comprises wires with a rubber adherable coating such as brass. The referenced corrosion resistant coatings in this application are zinc or a zinc binary or ternary alloy that comprises at least 50 wt % zinc. These coatings are alternatives i.e. the application does not mention that the coating can consist of zinc together with a zinc-alloy on the same wire.

EP-B1-1280958 discloses a steel cord adapted for the reinforcement of thermoplastic elastomers. The steel cord is a multi-strand steel cord. At least some the steel filaments have a zinc-iron alloy layer and on top of this zinc-iron alloy layer a separate layer of mainly zinc. The thickness of the separate top layer of zinc—not including the alloy layer—is smaller than two micrometer. This intermediate layer of a zinc-iron alloy and a relatively thin top layer of a zinc layer are obtained by means of a hot dip operation. The steel filaments are dipped into a bath of molten zinc. Instead of leaving the bath vertically, the filaments leave the bath under a small angle with respect to a horizontal line and a great amount of zinc is wiped off mechanically.

As mentioned in EP-B1-1280958, the resulting steel cords with such steel filaments have several advantages. First of all, due to the thin zinc layer, there are only a small number of separate zinc particles and less zinc dust is created in the processing of the steel cords. The reduction of zinc particles and of zinc dust increases the adhesion level. Secondly, due to the zinc-steel alloy layer, corrosion resistance is still much better than in the case of steel filaments which have been coated with zinc by means of an electrolytic deposition method. Thirdly, due to the zinc layer and zinc-iron alloy layer being also thinner, the level of fatigue resistance has significantly increased. Steel cords according to EP-B1-1280958 have given satisfactory results not only on a lab scale but on a wide scale in various industrial applications.

This wide commercial use, however, has also highlighted some points which are open for improvement.

First of all, although very thin, there is still zinc at the surface and zinc is known as difficult to twist in a downstream operation. Either the speed of twisting is seriously reduced, or lubrication becomes unavoidable. After the twisting process, the added lubricants need to be removed, since the presence of these lubricants would be at the detriment of the adhesion level in a polymer or elastomer matrix. Experience has shown, however, that complete removal of the lubricants is costly and time consuming.

Secondly, the presence of zinc at the surface, may lead to processability problems at the customer. An example is the extrusion of polymer strips around steel cords, if the steel cords have to pass through small openings before entering an extrusion apparatus, the steel cords rub against the wall of the openings; zinc becomes loose, heaps up locally and eventually blocks the whole processing. As will be described hereunder, the strips may show dark spots indicating the presence of zinc dust or may even loose their planar character. In extreme cases the steel cords were broken due to zinc dust blocking the extrusion dies.

SUMMARY OF THE INVENTION

It is a general aspect of the present invention to avoid the drawbacks of the prior art.

It is a first particular aspect of the present invention to facilitate the drawing of coated steel filaments.

It is a second particular aspect of the present invention to increase the level of adhesion.

It is a third particular aspect of the present invention to increase the processability of the steel cords.

Viewed from a first and broad perspective, the present invention provides a steel cord. The steel cord comprises more than one steel filament. At least some of the steel filaments have a zinc-iron alloy layer and, possibly, a zinc cover partially covering the zinc-iron alloy layer. Preferably the zinc cover is present in valleys in the zinc-iron alloy layer. The invention is featured by this zinc-iron alloy layer occupying more than fifty percent of the total volume of zinc-iron layer and zinc cover the steel filaments.

In a preferably embodiment of the invention, the zinc-iron alloy layer occupies more than 60%, e.g. more than 75%, e.g. more than 90%, e.g. more than 95% of the total volume of zinc-iron alloy and zinc cover. In other terms, the zinc-iron alloy layer occupies the majority of the volume of the coating.

Viewed from a second more detailed perspective, the present invention provides a steel cord. The steel cord comprises more than one steel filament. At least some of the steel filaments have a zinc-iron alloy layer and, possibly, a partial zinc cover above the zinc-iron alloy layer. The invention has the feature that the free surface of the zinc-iron alloy layer occupies more than fifty percent of the outer surface of said steel filaments. With 'free surface of the zinc-iron alloy layer' is meant that part of the surface of the filament where the zinc-iron layer is accessible from the outside of the filament i.e. is substantially uncovered or is visible from the outside. In a preferably embodiment of the invention, the free surface of the zinc-iron alloy layer occupies more than 60%, e.g. more than 75%, e.g. more than 90%, e.g. more than 95% of the outer surface of said filaments. It follows that the 'pure' zinc is only present in a minority of valleys, the majority of the outer surface of the filaments showing an iron-zinc alloy layer.

The measurement of volume occupied and surface exposed is done by means of the standard techniques of the metallurgist. To this end a filament is embedded in an epoxy matrix. A cross section substantially perpendicular to the axis of the filament is made and the section is carefully polished. By means of nital (a solution of about 2% nitric acid in alcohol that is well known to the metallurgist) the surface is slightly etched. After proper cleaning the section is observed under the optical microscope equipped with a suitable CCD camera that is connected to a computer for further numerical processing of the frames. The difference between steel, zinc-iron alloy layer and pure zinc can be clearly discerned after choosing the appropriate magnification and can be selected from the frame by the software. The ratio of pure zinc volume over total volume of pure zinc and zinc-iron alloy can be determined by calculating the ratio of the surface area in cross section of the pure zinc to the total surface area in cross section of the pure zinc together with the zinc-iron alloy layer. As no variations in zinc coating are generally observed in the longitudinal direction along the filament (given is method of production, see further), this ratio is only subject to minute variation in the length.

In the same manner the free surface of zinc-iron alloy can be measured by identifying on the frame those line sections that delineate the transition from the alloy layer to the epoxy, summing the line sections and dividing them by the overall length of the epoxy wire transition.

When the coating comes very thin, the frame analysis procedure can equally well be based on a Scanning Electron Microscope (SEM) picture in the same manner. The SEM allows for easy elemental analysis and the different layers (zinc-iron vs. pure zinc) can be discriminated in this way.

The avoidance of a continuous layer of zinc at the outer surface and the presence of iron-zinc alloy at the outer surface, offers a lot of advantages to the steel cord.

The reduced amount of 'pure' zinc together with the presence of a hard zinc-iron alloy layer at the surface result in a further reduction in the amount of zinc dust and zinc particles. Hence, the adhesion anchorage in a polymer or elastomer matrix can be further increased.

Another advantageous result is that processability problems, such as clogging of the extrusion dies or dark spots in extrusion strips are avoided or at least further reduced. It is hereby understood that the iron-zinc alloy layer at the surface adheres very well to the steel core of the steel filament and does not lead to zinc dust or zinc particles.

Viewed from a third perspective, the invention provides various uses or applications of the steel cord.

The steel cord may be used as an elevator rope. The steel cord may also be used as a window elevator rope. These ropes may be coated by means of a polymer or elastomer.

The steel cord may be used as a reinforcement of a thermoplastic elastomer or polymer, a vulcanisable rubber or a thermoset. The final product may then be a strip, a flexible pipes, a hose or a tire. The steel cord may be used as a reinforcement of concrete or for retrofitting of existing concrete structures.

BRIEF DESCRIPTION OF THE DRAWINGS

The invention will now be described into more detail with reference to the accompanying drawings wherein FIG. 1*a* gives a cross-section of a steel filament together with an enlarged view of part of this cross-section.

DESCRIPTION OF THE PREFERRED EMBODIMENTS OF THE INVENTION

Figure 1A:
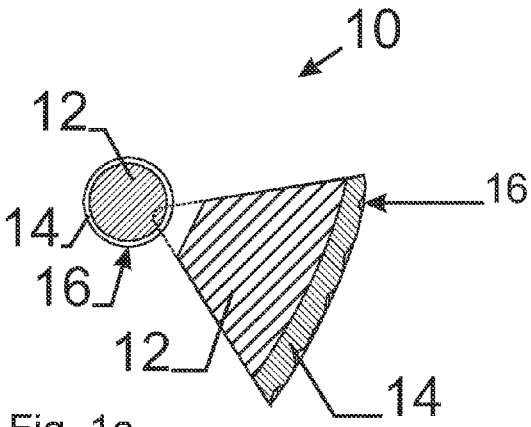
FIG. 1*b* gives an enlarged top view of a steel filament.
Figure 1B:
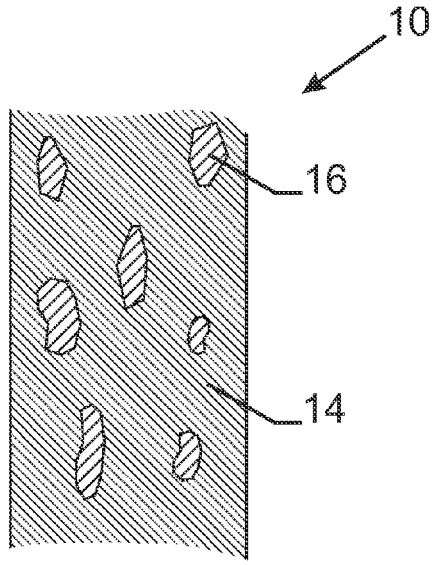

FIG. 1*a* gives a cross-section of a steel filament 10 used in a steel cord according to the invention. FIG. 1*a* also gives a part of an enlarged cross-section in order to explain better the coating design. FIG. 1*b* gives an enlarged top view of the surface of a steel filament 10. Steel filament 10 has a steel core 12. This steel core 12 is surrounded by an iron-zinc alloy layer 14. On top of the zinc-iron alloy layer 14, some zinc 16 may be present. Viewed from an optical microscope, it looks like a table-land with only a minority of the table-land occupied by small valleys. These small valleys are filled with zinc 16. The zinc-iron alloy can be present in its four phases, namely Zeta (5.8 to 6.7 wt % Fe), Delta (7 to 11.5 wt % Fe), Gamma (21 to 28 wt % Fe). The Eta phase that comprises at the most 0.03 wt % Fe is considered as pure zinc.

The manufacturing process of a steel filament with a cross-section as illustrated in FIG. 1 is as follows.

The steel filaments are made from wire rod with a steel composition which is along the following lines: a carbon content ranging from 0.30% to 1.15%, a manganese content ranging from 0.10% to 1.10%, a silicon content ranging from 0.10% to 0.90%, sulfur and phosphorous contents being limited to 0.15%, preferably to 0.10% or even lower; additional micro-alloying elements such as chromium (up to 0.20%-0.40%), copper (up to 0.20%) and vanadium (up to 0.30%) may be added.

The steel rod is cold drawn to the desired filament diameters. The subsequent cold drawing steps may be alternated by one or more suitable thermal treatments such as patenting, in order to allow for further drawing.

An iron-zinc alloy layer 14 can be obtained if, in contrast with an electrolytic deposition method of zinc, the steel wire is zinc coated by means of a hot dip operation. In a hot dip operation the steel wire travels through a bath of molten zinc and leaves the bath zinc coated.

The time of immersion and the temperature of the molten zinc determines the thickness of the iron-zinc alloy layer. The longer the immersion time or the higher the temperature of the molten zinc, the thicker the iron-zinc alloy layer 14.

In the context of the present invention the term 'zinc' refers to 100% pure zinc or to zinc alloys or zinc compositions with impurities or additional elements in such amounts that the creation and growth of a substantial iron-zinc alloy layer is not prevented.

As a first method of manufacturing and in analogy with EP-B1-1280958, the steel wire may leave the bath under a small angle with respect to a horizontal line and the leaving steel wire is wiped mechanically. In difference with EP-B1-1280958, however, the mechanical wiping is carried out twice in series.

Alternatively, as a second method of manufacturing, the mechanical wiping may be carried out under an increased pressure. This intense mechanical wiping reduces the amount of zinc 16.

As a third method of manufacturing, the cooling which is normally applied upon the wire leaving the zinc bath, is left out or is applied in a less intensive way, so that the growth of the iron-zinc alloy layer is not stopped immediately.

As a fourth method of manufacturing, the temperature of the zinc bath is increased in order to increase the speed of growth of the zinc-iron alloy layer.

The thus coated steel wire can be further drawn, e.g. by means of a cold drawing process, to the desired final diameter. The drawing smears out the zinc remaining and guarantees a longitudinally constant amount of zinc coating per unit of surface area.

Two or more filaments are then twisted into a steel cord, or in case of multi-strand steel cords, into a strand and two or more stands can be twisted into a final multi-strand steel cord. The twisting process can be done by means of tubular twisting machines or by means of double-twisting machines.

Figure 2:
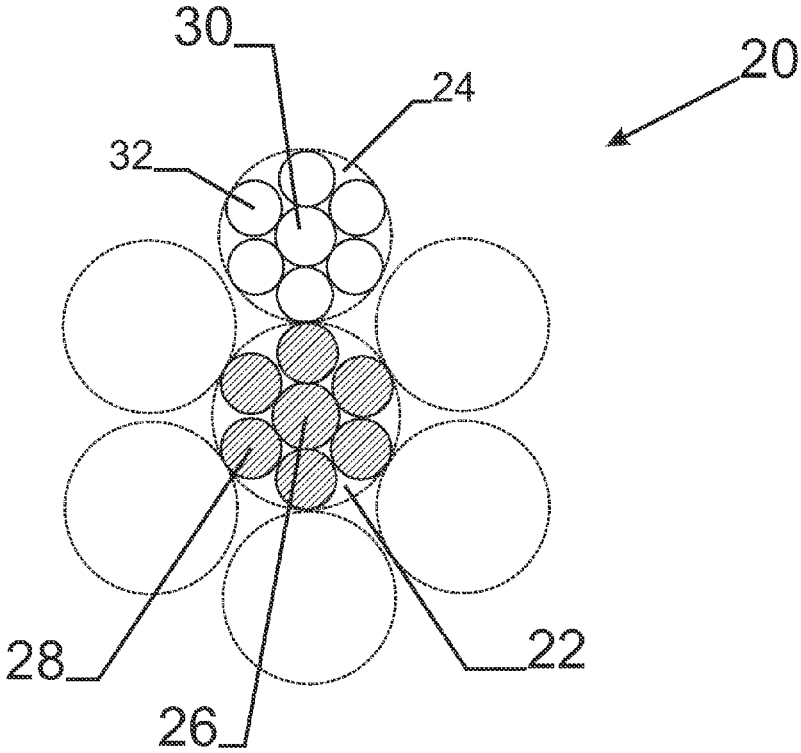
FIG. 2 gives a cross-section of a first embodiment of a steel cord according to the invention.

FIG. 2 shows a cross-section of a steel cord 20 according to the invention. The steel cord is a so-called 7×7 construction having seven strands where each strand has seven filaments. There is a core strand 22, surrounded by six layer strands 24. The core strand 22 has a core filament 26 which is in its turn surrounded by six layer filaments 28. The layer strands 24 each have a core filament 30 and each core filament 30 is in its turn surrounded by six layer filaments 32.

Possible configurations are:

7×7×0.175 10/14 SZ (i.e. all filaments have the same diameter)

and $d_1+6\times d_2+6\times(d_2+6\times d_3)$ P1P2 SZ with $d_1>1.05\times d_2$ and $d_2>1.05\times d_3$, where $d_1$ is the diameter of the core filament 26 of core strand 22, $d_2$ is the diameter of layer filament 28 of core strand 22 and is the diameter of the core filament 30 in the layer strands 24 and $d_3$ is the diameter of the layer filaments 32 in the layer strands 24.

Due to the difference in filament diameters, this latter configuration has the advantage of having both open strands and a more open steel cord. This openness is advantageous for mechanical anchoring of the steel cord in a matrix material such as a thermoplastic material or an elastomer.

Following examples are here given by way of illustration:

0.21+6×0.19+6×(0.19+6×0.175)

0.25+6×0.23+6×(0.23+6×0.21)

0.26+6×0.24+6×(0.24+6×0.22)

0.39+6×0.34+6×(0.34+6×0.30)

Figure 3:
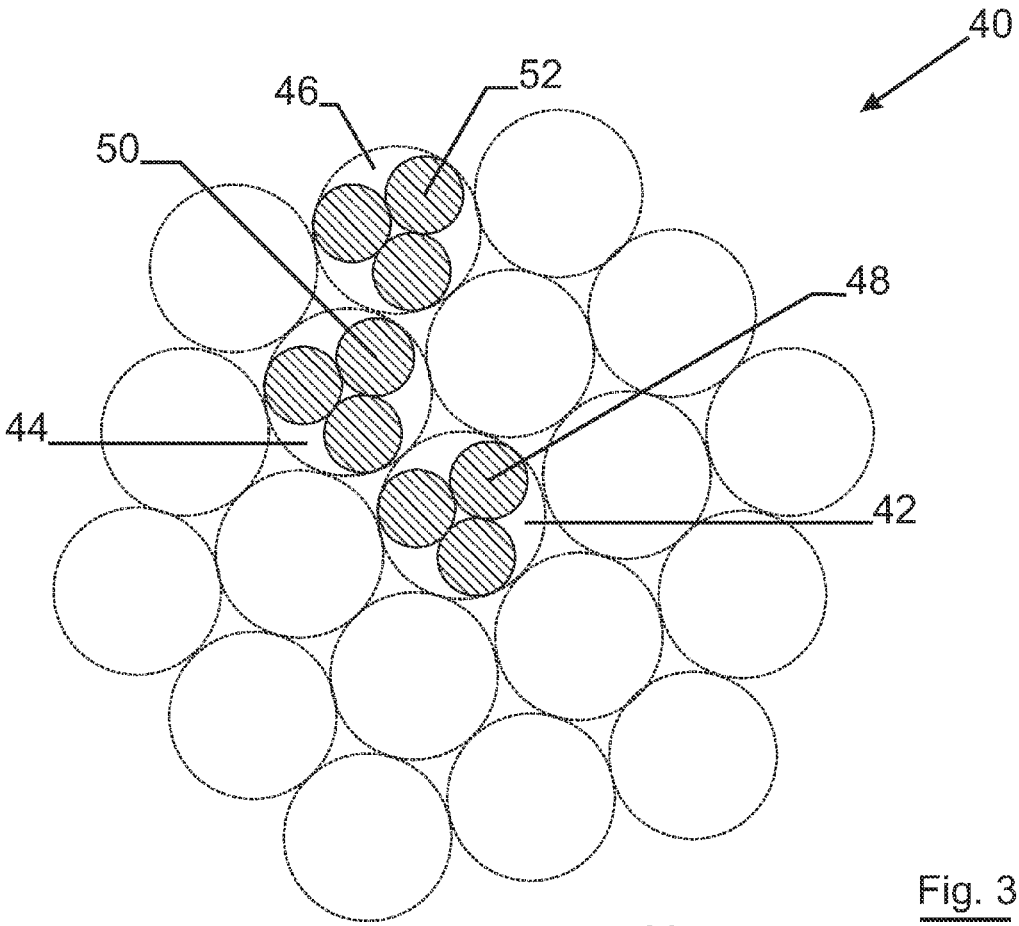
FIG. 3 gives a cross-section of a second embodiment of a steel cord according to the invention.

FIG. 3 illustrates the cross-section of another steel cord 40. The steel cord 40 has a core strand 42, six intermediate layer strands 44 and twelve outer layer strands 46. All strands have been twisted in the same twist direction and with the same twisting step into the cord. The strands in the cord form a compact configuration of of strands. The core strand has three steel filaments 48, each intermediate layer strand has three steel filaments 50 and each outer layer strand has three steel filaments 52. Such steel cord 40 can be designated as a 19×3 construction and has been disclosed in U.S. Pat. No. 5,768,874. Alternative configurations consisting of 1+3×N (N=3, 4, 5 . . . ) strands exist such as 16×3. Alternatively, the strands can comprise only two filaments leading to the type 19×2 or 16×2. In comparison with the steel cord of FIG. 2 where two manufacturing steps are needed, this steel cord 40 can be made in one single twisting step. Also the compact cord where the strands are replaced by single filaments can be produced of filaments with the particular coating. One then obtains e.g. 19×0.225, whereby 0.225 is an indication of the diameter of the filament.

Another suitable construction has as general formula 19+8×7. Following examples are given by way of illustration:

(0.19+18×0.17)+8×(0.16+6×0.16) (compact core);

(0.19+18×0.17)+8×(0.17+6×0.155) (compact core);

(0.17+6×0.16+6×0.17+6×0.13)+8×(0.14+6×0.14) (Warrington core);

(0.17+6×0.16+6×0.17+6×0.13)+8×(0.15+6×0.14) (Warrington core);

(0.155+6×0.145+12×0.145)+8×(0.14+6×0.14).

Figure 4A:
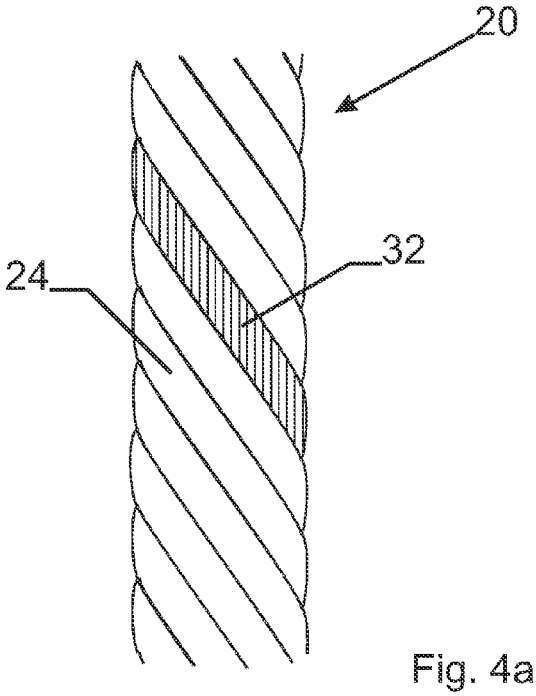
FIG. 4*a* and FIG. 4*b* illustrate the use of a steel cord as an elevator rope or a window elevator rope.
Figure 4B:
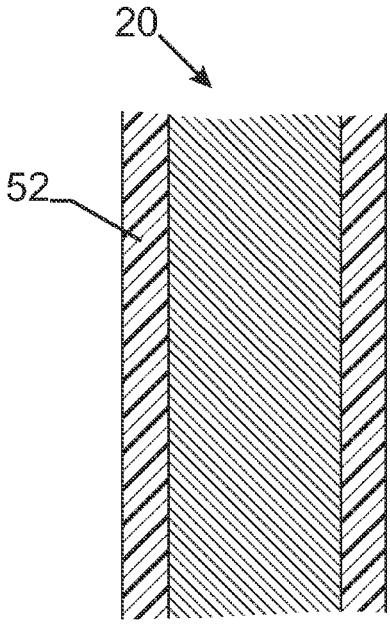

FIG. 4*a* and FIG. 4*b* give a side view of steel cord 20 (cross-section in FIG. 2) and illustrate the use of steel cord 20 as an elevator rope or a control cable such as a window elevator rope or a sliding door rope. FIG. 4*a* shows a steel cord 20 which is not coated by means of a synthetic layer. FIG. 4*b* shows a steel cord 20 which has been coated by a synthetic layer 52, such as a layer of polyurethane.

Figure 5:
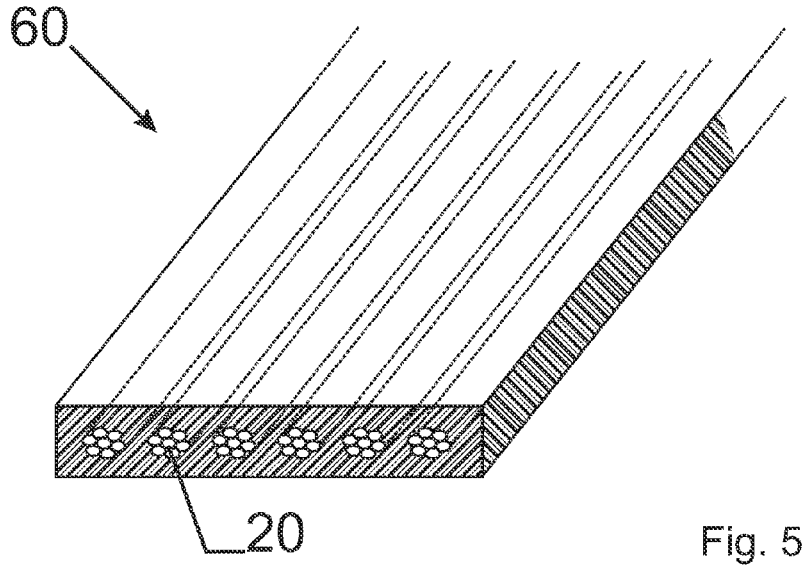
FIG. 5 illustrates the use of a steel cord as reinforcement of a strip.

FIG. 5 illustrates a strip 60 which is reinforced by means of several steel cords 20 located on a same plane. The strip 60 can be a rubber strip, a strip 60 out of a thermoplastic, or an elastomer material such as polyurethane. Such steel cord reinforced strips 60 can be used in or on bumpers, in elevators, in flexible pipes and hoses, as sheet-linings, snap-on profiles, cut-resistant flexible and protective strips, handrails.

Figure 6:
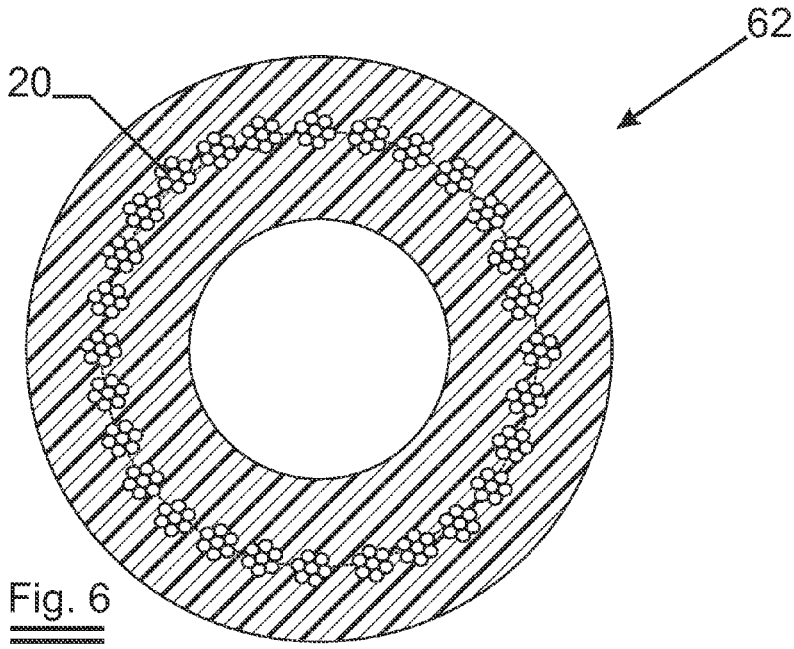
FIG. 6 illustrates the use of a steel cord as reinforcement of a flexible pipe or hose.

FIG. 6 illustrates a flexible pipe or hose 62 reinforced by means of steel cords 20. Here again, the matrix material of the hose can be a thermoplastic, an elastomer or a rubber.

The adhesion level of an invention cord has been compared with the adhesion level of a prior art cord. Both cords are of the following formula: 7×3×0.15. The invention cord and the prior art cords are embedded in a polyurethane matrix over an embedment length of 25 mm. The pull-out force, i.e. the force needed to pull the steel cords out of the polyurethane matrix, is a measure for the adhesion level and is recorded. The following table mentions the relative values of these pull-out forces.

TABLE

| Sample | Adhesion level (%) |
|---|---|
| Prior art cord 1 | 100 |
| Prior art cord 2 | 76 |
| Prior art cord 3 | 80 |
| Prior art cord 4 | 87 |
| Prior art cord 5 | 78 |
| Invention cord 1 | 140 |
| Invention cord 2 | 142 |
| Invention cord 3 | 137 |
| Invention cord 4 | 141 |
| Invention cord 5 | 142 |

Figure 7:
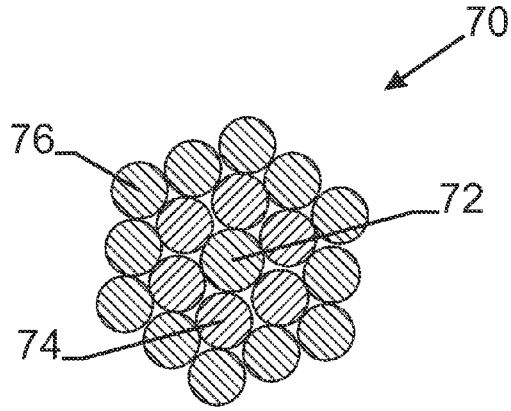
FIG. 7 gives a cross-section of a third embodiment of a steel cord according to the invention.

FIG. 7 shows the cross-section of a third embodiment of a steel cord 70. The steel cord 70 is not a multi-strand steel cord as steel cord 20 of FIG. 2 or as steel cord 40 of FIG. 3. Steel cord 70 is called a layered cord. Steel cord 70 has a center filament 72, an intermediate layer of steel filaments 74 twisted around the center filament 72 and an outer layer of steel filaments 76 twisted around the intermediate layer.

Steel cord 70 corresponds to formula $d_1+18\times d_2$.

Figure 8:
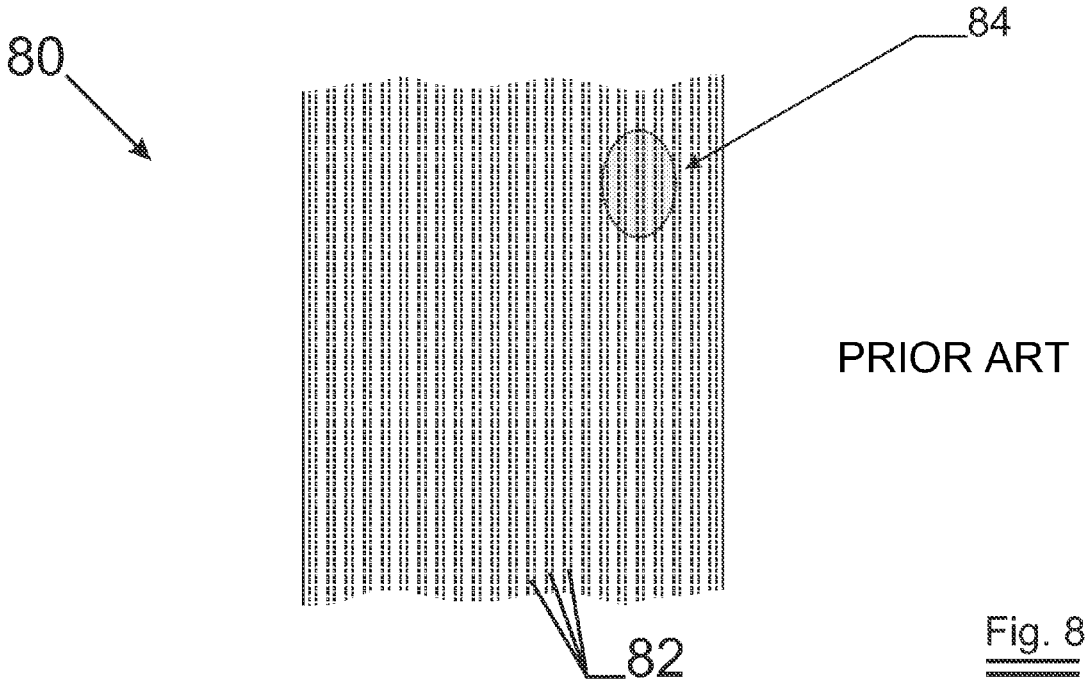
FIG. 8 and FIG. 9 illustrate prior art strips.

FIG. 8 illustrates a drawback of the prior art. The polyurethane strip 80 has been reinforced by means of prior art steel cords 82 lying more or less parallel to each other. Reference FIG. 84 points to a darker spot on the strip. This dark spot is a result of zinc dust or zinc particles which has been formed during the processing of the steel cords 82. In the neighborhood of this dark spot 84, the adhesion of the steel cords 82 with the polyurethane matrix is lower than in other regions.

Figure 9:
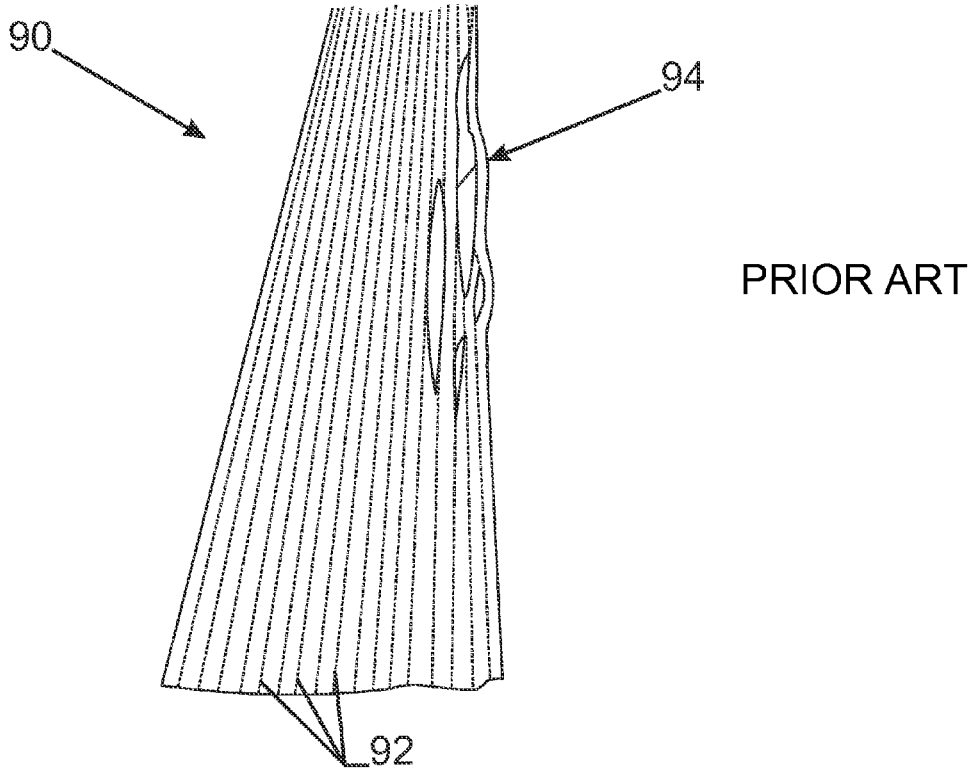

FIG. 9 illustrates another drawback of the prior art in a more dramatic situation. A polyurethane strip 90 which is reinforced by means of steel cords 92 is shown. In the beginning of the extrusion process of the strip 90, the strip remained very flat in a plane. However, after a while zinc particles which have come loose from the zinc coating on the steel cord, started to clog the extrusion dies. The strip lost its planar form. The situation became even worse when some of the steel cords broke and were no longer covered with polyurethane as indicated by arrow 94.

The invention claimed is:

1. A steel cord, said steel cord comprising more than one steel filament, at least some of said steel filaments having a zinc-iron alloy layer partially covered with a zinc cover, wherein said zinc-iron alloy layer occupies more than fifty percent in volume of a total volume of said zinc cover and said zinc-iron alloy layer.

2. The steel cord according to claim 1, wherein said zinc-iron alloy layer occupies more than ninety percent in volume of the total volume of said zinc cover and said zinc-iron alloy layer.

3. The steel cord according to claim 1, wherein a free surface of the iron-zinc alloy layer occupies more than fifty percent of a total outer surface of said filament.

4. The steel cord according to claim 3, wherein said free surface of the zinc-iron alloy layer occupies more than seventy-five percent of said total outer surface of said filament.

5. The steel cord according to claim 1, wherein said zinc cover is present in valleys formed in said zinc-iron alloy layer.

6. A steel cord according to claim 1, wherein said steel cord has a 7×7 construction.

7. A steel cord according to claim 1, wherein said steel cord has a compact construction of 19 or 16 or any other number of elements allowing a compact construction, said elements being a single filament or a strand with two or three filaments.

8. A steel cord according to claim 1, wherein said steel cord has a core strand of 19 filaments surrounded by 6, 7, 8, 9 or 10 strands of 7 filaments.

9. An elevator rope or a control cable, comprising the steel cord of claim 1.

10. A reinforcement of strips or timing belts, comprising the steel cord of claim 1.

11. A reinforcement of flexible pipes, comprising the steel cord of claim 1.

12. Reinforcement or retrofitting for concrete, comprising the steel cord of claim 1.

13. A window elevator cord, comprising the steel cord of claim 1.

* * * * *